US005597210A

United States Patent [19]

Pickard

[11] Patent Number: 5,597,210

[45] Date of Patent: Jan. 28, 1997

[54] FOLDABLE CHAIR WITH RETRACTABLE LEG REST

[76] Inventor: Peter B. Pickard, R.D. #7, Box 142, Rome, N.Y. 13440

[21] Appl. No.: 377,039

[22] Filed: Jan. 23, 1995

[51] Int. Cl.[6] ..... A47C 1/034

[52] U.S. Cl. ..... 297/423.36; 297/423.31; 297/423.3

[58] Field of Search ..... 297/70, 69, 423.31, 297/423.36, 423.3

[56] References Cited

U.S. PATENT DOCUMENTS

| | | | |
|---|---|---|---|
| 128,804 | 7/1872 | Mains . | |
| 357,955 | 2/1887 | Ferst | 297/70 |
| 639,076 | 12/1899 | May | 297/69 X |
| 1,939,568 | 3/1933 | Panhorst . | |
| 2,230,685 | 2/1941 | Haschke . | |
| 2,276,053 | 3/1942 | Luckhardt et al. . | |
| 2,383,340 | 6/1944 | Pezzano . | |
| 2,833,338 | 5/1958 | Fidel | 297/423.31 |
| 3,087,757 | 4/1963 | Fidel . | |
| 4,336,965 | 6/1982 | Lipp | 297/423.36 |
| 4,509,795 | 4/1985 | Brennan et al. | 297/423.36 X |
| 5,033,793 | 7/1991 | Quintile | 297/423.36 X |
| 5,087,094 | 2/1992 | Rogers, Jr. | 297/69 X |
| 5,088,789 | 2/1992 | LaPointe et al. | 297/69 |
| 5,328,247 | 7/1994 | Lovins | 297/423.36 X |
| 5,354,116 | 10/1994 | May et al. | 297/70 X |

FOREIGN PATENT DOCUMENTS

| | | | |
|---|---|---|---|
| 549954 | 12/1959 | Belgium | 297/423.31 |
| 558830 | 4/1960 | Belgium | 297/70 |

*Primary Examiner*—Peter M. Cuomo
*Assistant Examiner*—David E. Allred
*Attorney, Agent, or Firm*—Harris Beach and Wilcox, LLP

[57] ABSTRACT

A foldable deck chair having a lever actuated leg rest that includes a pair of support members that are arranged to swing upwardly from a stored position between the front legs of the chair to a fully raised horizontal position in front of the chair. Extendable arms are slidably mounted upon the support members and move outwardly as the support members are moved from the stored position to the extended position to increase the length of the rest.

8 Claims, 5 Drawing Sheets

20
29
80
30
12
27
11
3
3
20
30
22
80
33
12
27
29
11
10
14
16
19

FOLDABLE CHAIR WITH RETRACTABLE LEG REST

BACKGROUND OF THE INVENTION

This invention relates to a foldable or deck chair, and in particular, to a foldable deck chair that has a full length leg rest that can be conveniently folded into the chair frame by a person seated in the chair.

Foldable deck chairs are well known in the art. As shown in U.S. Pat. No. 1,939,568 some of these chairs are equipped with leg rests that support the legs of a person seated in the chair in an out-stretched horizontal position. These leg rests, although comfortable, have certain disadvantages. If the rest is long enough to accommodate the legs of a normal sized person, the rest cannot be conveniently folded into the chair frame, and as a result, the folded chair typically is extremely bulky and thus difficult to carry and store. On the other hand, if the leg rest is small enough to be folded into the chair frame, it is not long enough to accommodate the legs of an average person, and consequently, the legs of one seated in the chair extend well beyond the end of the rest. This, of course, is uncomfortable and places undue stress on the persons limbs.

The leg rests of most folding chairs cannot be folded or unfolded by one sitting in the chair. When the rest is in an extended unfolded condition, getting in and out of the chair can be a problem, particularly for a person that is infirmed or has a disability. Folding or unfolding of the rest typically requires that the user leave the chair to carry out the desired positioning. This, of course, is inconvenient and limits the usefulness of the chair.

SUMMARY OF THE INVENTION

It is therefore an object of the present invention to improve folding deck chairs.

It is a further object of the present invention to provide a full length leg rest for a foldable deck chair that can be folded into the chair frame to provide a compact easily portable and storable unit.

It is a still further object of the present invention to provide a full length leg rest for a deck chair that can be easily folded and unfolded into the chair frame by a person while seated in the chair.

Another object of the present invention is to improve the portability of a foldable deck chair that is equipped with a leg rest.

Still another object of the present invention is to improve the comfort of a foldable deck chair having a leg rest.

These and other objects of the present invention are attained by a foldable deck chair that includes a pair of opposed support members pivotally mounted between the front legs of the chair. The support members are movable between a stored position adjacent to the front legs to an elevated horizontal position extending outwardly from the legs. A manually operated lever arm, that can be actuated by a person while seated in the chair, is connected to the support members and serves to move the support members between a stored and an extended-position. A pair of extendable arms are slidably mounted upon the support members and connected thereto by a control linkage so that arms move forward of the support members as the support member moves upwardly into the extended position thereby increasing the length of the leg rest. The linkage also operates to move the arms back along the support members as the support members are returned from the extended position into the stored position. The support members and extendable arms are covered with a fabric which becomes taut as the leg rest is raised and folded when the leg rest is stored.

BRIEF DESCRIPTION OF THE DRAWINGS

For a better understanding of these and other objects of the present invention reference will be made to the following detailed description of the invention which is to be read in association with the accompanying drawings wherein.

DESCRIPTION OF THE INVENTION

Figures 1, 2:
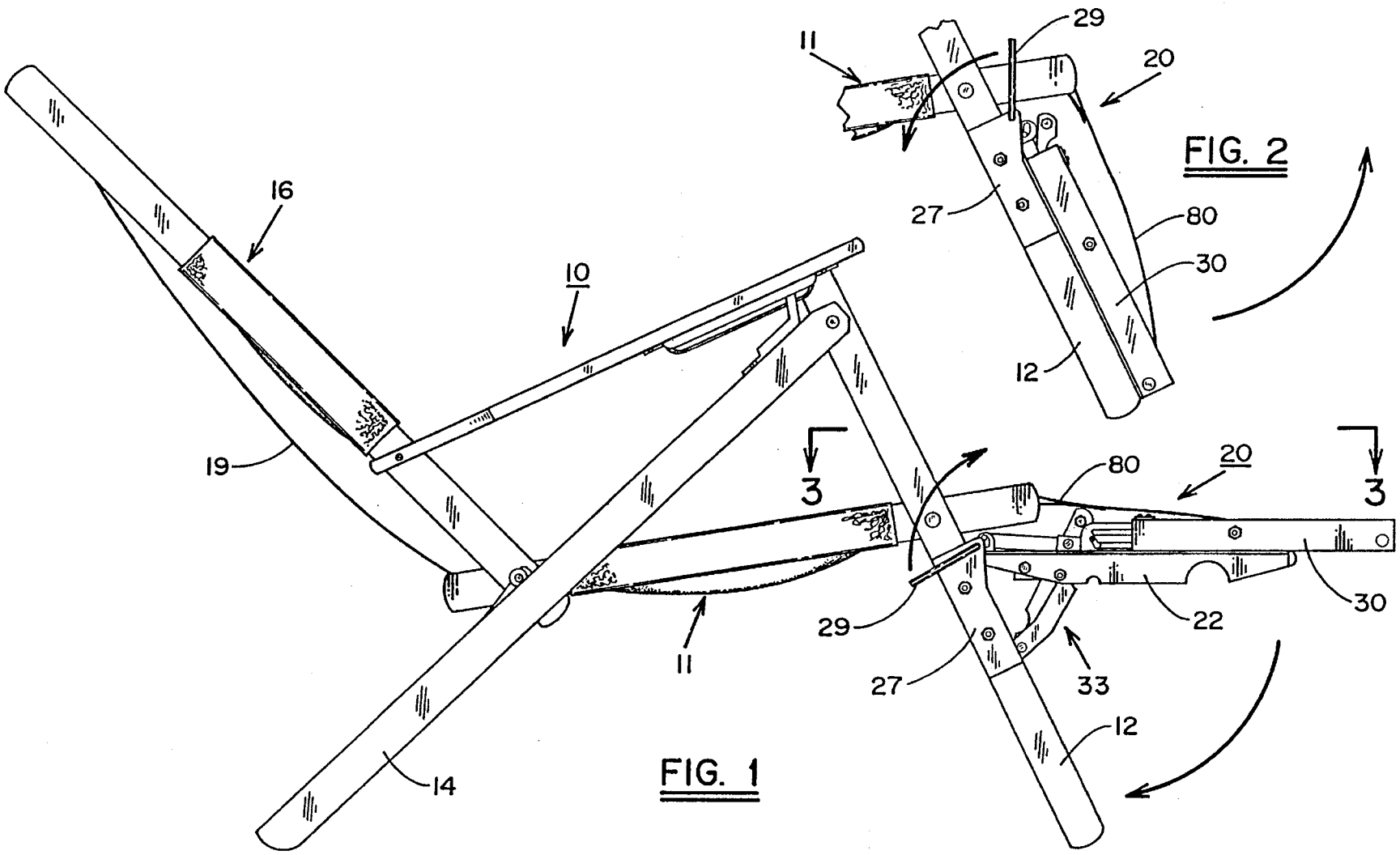
FIG. 1 is a side elevation of a deck chair embodying the teaching of the present invention showing the leg rest in an extended position.
FIG. 2 is a partial side view showing the leg rest of the chair in a stored position.
Figure 3:
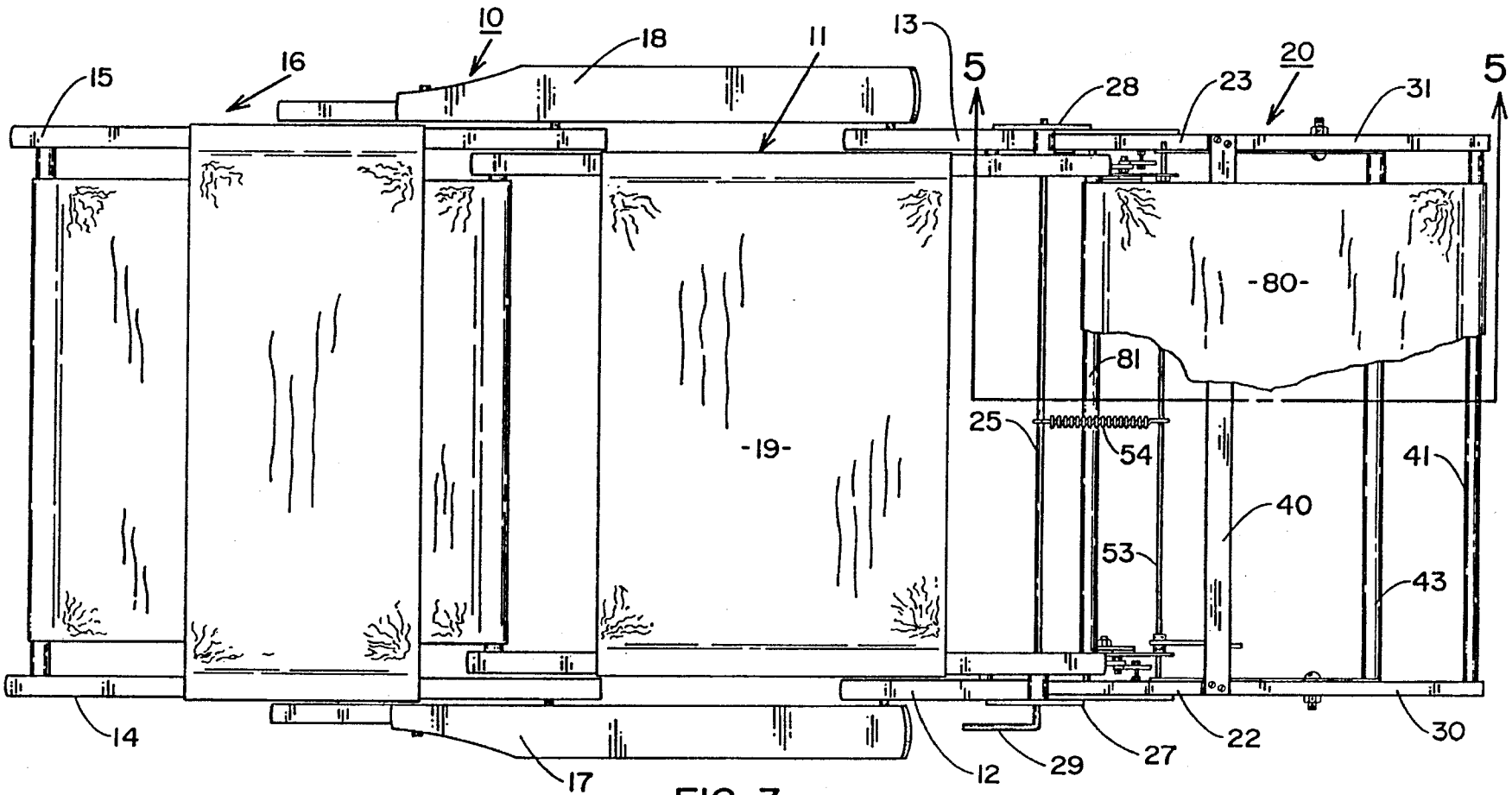
FIG. 3 is a top view with portions broken away shown in the present deck chair in an unfolded condition.

Referring initially to FIGS. 1–3, there is shown a foldable deck chair, generally referenced 10, that includes a seat 11 that is suspended between a pair of front legs 12 and 13 and a pair of rear legs 14 and 15. A back rest 16 is mounted at the rear of the seat and is adjustably attached to the top section of the front legs by means of a pair of arm rests 17 and 18. The seat and the back rest are furnished with a fabric covering 19. As is well-known in the art, the various components making up the chair are pivotally attached one to another so that the chair may be folded into a flat unit that is easily portable or stored.

A leg rest embodying the teachings of the present invention, generally referenced 20, is suspended between the two front legs of the chair immediately below the seat. The leg rest includes a pair of main support members 22 and 23 that are coupled to a main drive shaft 25. The drive shaft is rotatably supported between the two front legs of the chair in side brackets 27 and 28. The right side of the shaft, as shown in FIG. 3 terminates in a lever arm 29 that is easily accessible to a person seated in the chair. As will be explained in greater detail below, rotating the lever arm in a counterclockwise direction will cause the two main support members to move upwardly from a stored position between the two front legs as shown in FIG. 2 to a generally horizontal elevated position, as shown in FIGS. 1 and 3. Moving the lever arm in the opposite direction will return the support members to the stored position.

A pair of extendable arms 30 and 31 are slidably mounted on top of the two main support members and are connected to the main support members by a linkage assembly 33 so that the arms are moved outwardly as the main support members are rotated from the stored to the elevated position thereby considerably increasing the length of the leg rest. Returning the main support members to the stored position will cause the arms to be retracted along the support members.

Figure 4:
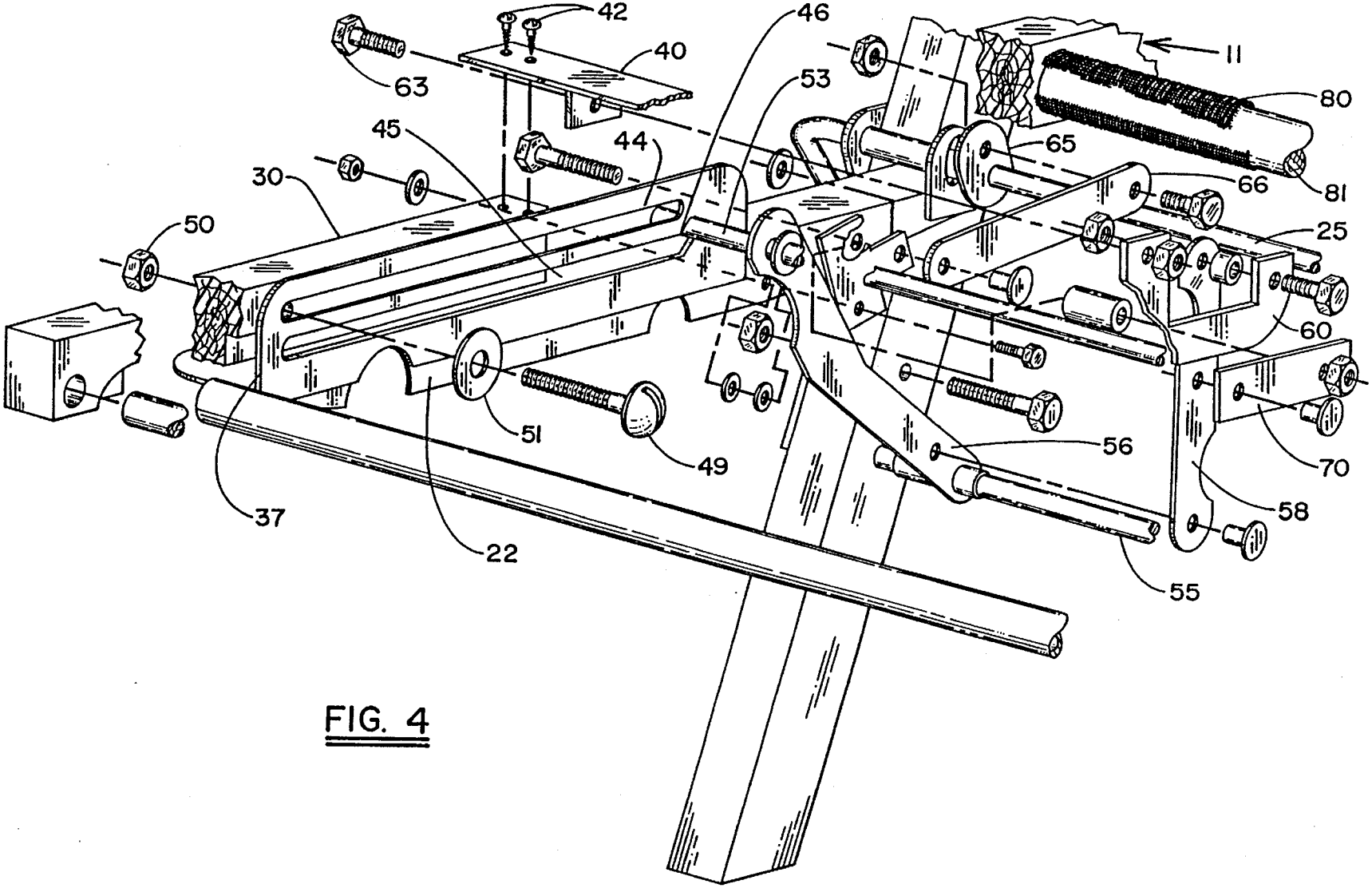
FIG. 4 is an exploded view in perspective showing the right hand position of the leg rest actuating mechanism in the extended position.
Figures 5, 6:
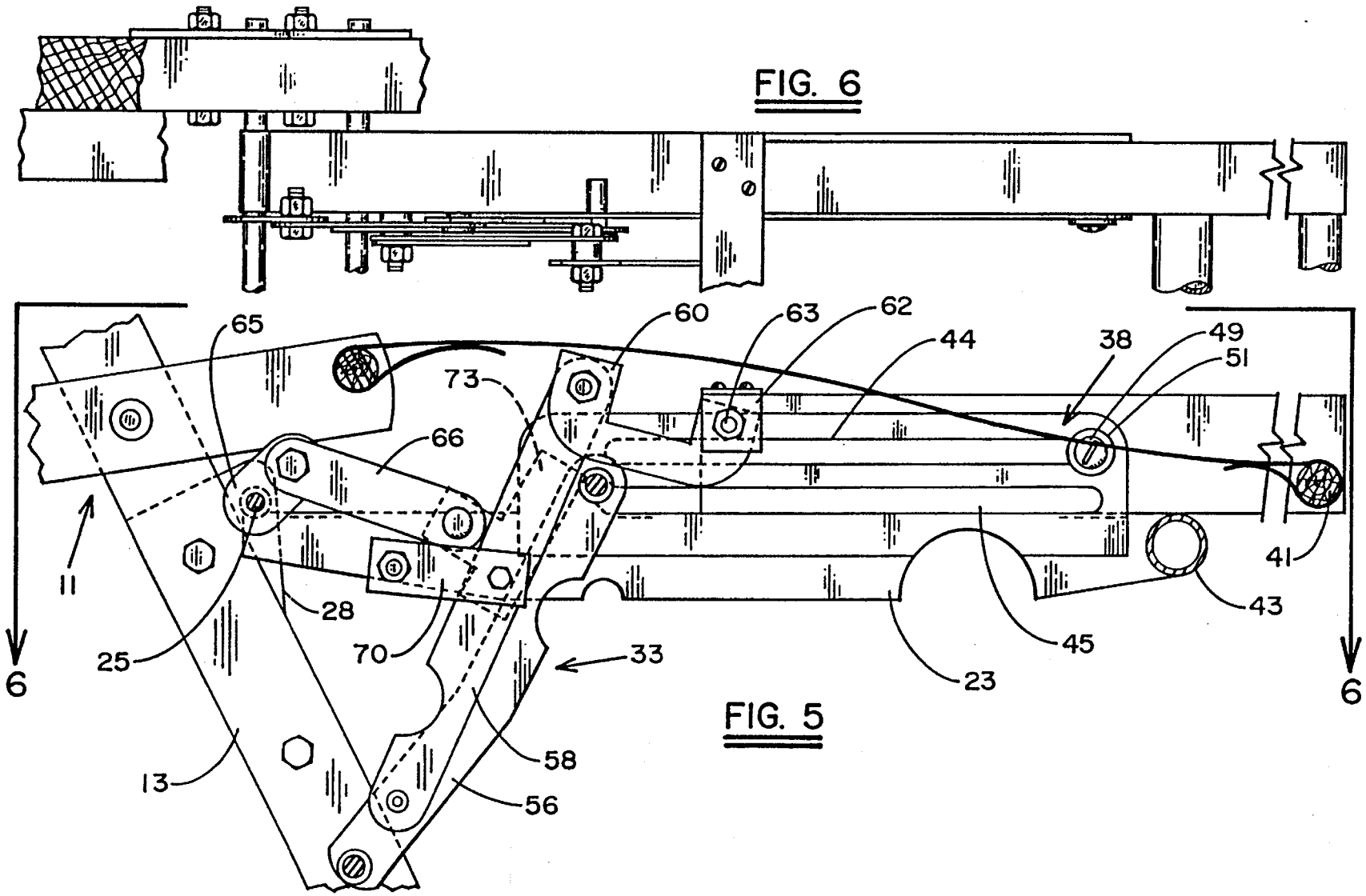
FIG. 5 is an enlarged partial view taken along lines 5—5 in FIG. 3 further showing the left hand portion of the leg rest actuating mechanism in the extended position.
FIG. 6 is a partial view taken along lines 6—6 in FIG. 5.

Turning now to FIG. 4, there is shown the right hand side of the linkage assembly, that is associated with the right side support member 22, which coordinates the movement of the extendable arms with that of the support members. The left hand side of the linkage assembly-which is associated with the left side support member 23 is shown in greater detail in FIGS. 5–7. The linkage includes a pair of opposed slide members 37 and 38 that are affixed to the inside of the two main support members 22 and 23, respectively. The two extendable arms of the leg rest are held in parallel alignment by means of a rear bracket 40 and front dowel 41 to establish a frame link assembly whereby the arms move together as a unit along the support members. The bracket 40 is connected to the arms by screws 42 while the dowel is press fitted into holes formed in the front of the arms (FIG. 4). The front or distal end of the two opposed main support members are secured together in assembly by means of a cross member 43.

Each of the two slide members is equipped with an upper guide rail 44 and a lower guide rail 45. The back of each lower guide rail is turned upwardly to form a stop latch 46, the function of which will be explained in greater detail below. The extendable arms of the rest are slidably contained in the upper guide rails by means of threaded pins 49. The pins are arranged to pass through the guide rails and the extendable arms and are held in place by nuts 50. A washer 51 is placed between the head of each pin and the slide members. A horizontally disposed follower shaft 53 is slidably contained in the two opposed lower guide rails and is urged rearwardly toward the stop latch 46—46 by a spring 54 (FIG. 4). The follower arm is connected to a fixed cross bar 55, which is mounted between the front legs of the chair, by two control arms 56—56. Links 58—58 are pinned in the lower section of each control arm and the upper section of each link is, in turn, pivotally coupled to the bracket 40 connecting the two extendable arms by means of u-shaped rocker arms 60—60. The rocker arms are pivotally mounted in the bracket 40 by plates 62—62 (FIGS. 4 and 5) and spacer bolts 63—63.

A bar 65 is fixed to both ends of the main drive shaft 25 as by welding at a predetermined angle and is, in turn, rotatably coupled to a strut 66 to form a two bar lifting mechanism for raising and lowering the main support members. Struts 66 are pivotally attached to the two main support members 22 and 23 forward of the lever actuated main drive shaft 25. Each two bar lifting mechanism is situated in assembly so that it aids in the raising and lowering of the support members as the lever 29 is rotated in either direction. A control link 70 is pivotally supported by suitable spacer pins between the back of each main support member and the adjacent control arm 56. A T-shaped member 73 is pivotally connected between each strut 66 and the back of each support member to complete the control linkage.

To raise the leg rest from the stored position, the lever arm of the main drive shaft is turned in a counter-clockwise direction as shown in FIG. 2. This causes struts 66 to begin to turn and lift the main support members about the main drive shaft. At this time, the follower shaft 53 is positioned fully forward in the lower guide rails 45—45 and under the urging of spring 54 begins to move back along the guide rails toward the stop latch 46. Simultaneously therewith, the linkage connecting the lifting mechanism to the control arms 56—56 drives the two extendable arms forwardly within the upper guide rails 44—44. The motion of the main support members and the extendable arms is coordinated through the connecting control linkage and the guide rials so that the arms move smoothly to the fully extended position as the support members are rotated from a stored position between the front leg of the chair to a raised horizontal position in front of the chair legs. Once the main support members reach the fully raised position, the follower shaft 53 is pulled by the spring 54 into the stop latches 46—46 thus locking the leg rest in the fully raised position.

Figure 7:
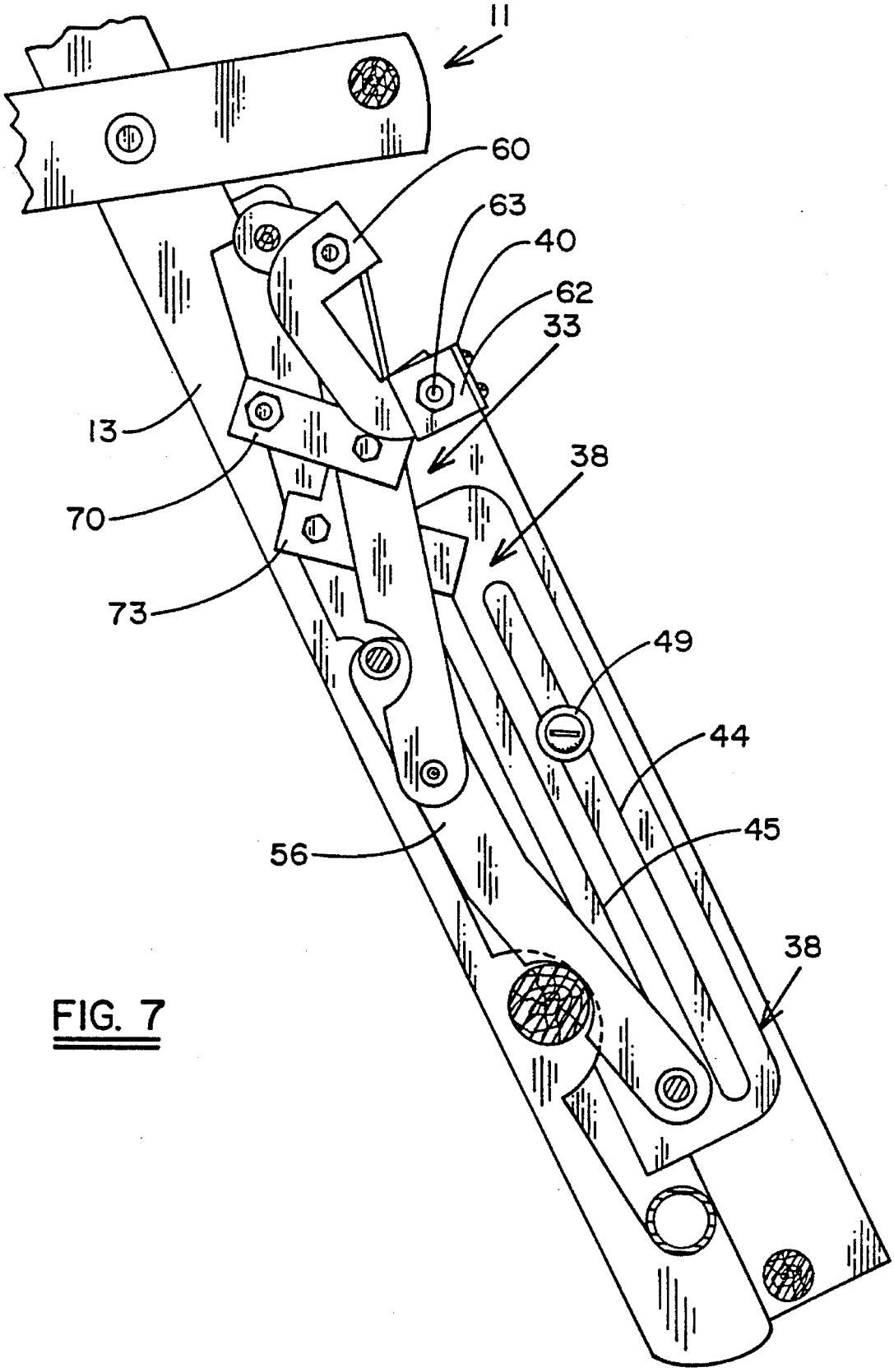
FIG. 7 is a partial side view showing a portion of the leg actuating mechanism mounted on the left leg of the chair in the stored position.

To return the leg rest to the stored position, the lever arm 29 is turned in a clock-wise direction forcing the follower shaft out of the stop latches and rotating the main support members downwardly through means of the control linkage. Here again, the control linkage acting between the main support members and the extendable arms draws the arms back along the main support members thus shortening the leg rest structure as it is being moved to the stored position so that it will fit beneath the chair seat between the front legs. When, the follower shaft reaches full travel in the lower guide rails, rotation of the support members is terminated. This occurs when the main support members are adjacent to and parallel with the front legs, as illustrated in FIGS. 2 and 7.

A piece of fabric 80 is secured at one end to the front beam 81 of the chair seat. The opposite end of the fabric is similarly secured to the dowel 41 mounted between the extendable arms 30 and 31. When the leg rest is in the fully raised position, the fabric piece is pulled taut to provide a comfortable support for the legs of a person who is seated in the chair. The fabric piece is conveniently folded back when the leg rest is moved to the stored position.

While this invention has been explained with reference to the structure disclosed herein, it is not confined to the details set forth and this invention is intended to cover any modifications and changes as may come within the scope of the following claims:

What is claimed is:

1. A foldable chair having a seat and a pair of spaced apart front legs, said chair including a pair of opposed support members pivotally mounted upon the front legs of the chair beneath the seat;

said support members being rotatable between a stored position wherein the members are adjacent to and parallel with the front legs of the chair and a raised position wherein said members protrude outwardly from said legs;

actuating means connected to said support members by a linkage means which manually moves the support members between said stored position and said elevated position;

a pair of extendable arms, slidably mounted upon the support members;

said linkage means further connected between the actuating means and the extendable arms for moving the arms from a fully retracted position when the support members are in the stored position to a fully extended position when the support members are in the raised position; and first and second guide rail means mounted upon each of said support members, said first and second guide rail means positioned parallel with and superimposed on each of said support members, said extendable arms being slidably mounted in said first guide rail means and said linkage means slidably mounted in said second guide rail means whereby the motion of the extendable arms is coordinated through said linkage means with the motion of the support members.

2. A foldable chair having a seat and a pair of spaced apart front legs, said chair including a pair of opposed support members pivotally mounted upon the front legs of the chair beneath the seat;

said support members being rotatable between a stored position wherein the members are adjacent to and parallel with the front legs of the chair and a raised position wherein said members protrude outwardly from said legs;

actuating means connected to said support members for manually moving the members between said stored position and said elevated position;

a pair of extendable arms, slidably mounted upon the support members;

linkage means connected between the actuating means and the extendable arms for moving the arms from a fully retracted position when the support members are in the stored position to a fully extended position when the support members are in the raised position;

first and second guide rail means mounted upon each of said support members, said extendable arms being slidably mounted in said first guide rail means of each support member and said linkage means slidably mounted in said second guide rail means whereby the motion of the extendable arms is coordinated through said linkage means with the motion of the support members; and a bracket means for cojoining the two extendable arms and further including a connecting means for coupling the linkage means to said bracket means.

3. The foldable chair of claim 2 wherein said linkage means is connected to a follower bar that is slidably contained within said second guide rail means.

4. The foldable chair of claim 3 wherein said second guide rail means includes a latching means for securing the follower bar when the support members are rotated into the elevated position.

5. The folding chair of claim 4 that further includes a spring means acting on said follower bar to urge said follower bar into engagement with the latching means.

6. A foldable chair having a seat and a pair of spaced apart front legs, said chair including a pair of opposed support members pivotally mounted upon the front legs of the chair beneath the seat;

said support members being rotatable between a stored position wherein the members are adjacent to and parallel with the front legs of the chair and a raised position wherein said members protrude outwardly from said legs;

actuating means connected to said support members for manually moving the members between said stored position and said elevated position;

a pair of extendable arms, slidably mounted upon the support members; and linkage means connected between the actuating means and the extendable arms for moving the arms from a fully retracted position when the support members are in the stored position to a fully extended position when the support members are in the raised position; and a fabric cover connected at one end to the chair frame and at the other end to a cross member suspended between the extendable arms.

7. The foldable chair of claim 3 that further includes a control arm pivotally attached at one end to each of the front legs of the chair and at the other end to the follower bar.

8. The foldable chair of claim 7 wherein each control arm is also pivotally attached to the bracket means through said linkage means.

* * * * *